United States Patent [19]

Solmon et al.

[11] 4,101,909

[45] Jul. 18, 1978

[54] MAGNETIC INKING APPARATUS FOR PULSED ELECTRICAL PRINTING

[75] Inventors: Donald C. Solmon, Newburyport; Donald J. J. Lennon, Acton, both of Mass.

[73] Assignee: Epp Corp., Boston, Mass.

[21] Appl. No.: 710,280

[22] Filed: Jul. 30, 1976

[51] Int. Cl.[2] ..... G03G 15/16

[52] U.S. Cl. ..... 346/153; 118/658; 346/74.1

[58] Field of Search ..... 346/150, 153, 155, 74.1; 118/658, 661

[56] References Cited

U.S. PATENT DOCUMENTS

| | | | |
|---|---|---|---|
| 3,257,222 | 6/1966 | Carlson | 346/153 |
| 3,419,884 | 12/1968 | Betts | 346/153 |
| 3,530,794 | 9/1970 | Ritzerfield | 346/153 |
| 3,816,840 | 6/1974 | Kotz | 346/153 |
| 3,879,737 | 4/1975 | Lunde | 346/153 |
| 3,929,098 | 12/1975 | Liebman | 346/153 |
| 3,937,181 | 2/1976 | Handa | 118/658 |
| 3,967,892 | 7/1976 | Whited | 118/658 |
| 4,022,157 | 5/1977 | Rasekhi | 118/658 |

*Primary Examiner*—Jay P. Lucas
*Attorney, Agent, or Firm*—Kenway & Jenney

[57] ABSTRACT

A non-impact printer having a moving support for supplying particles of magnetic ink. The ink particles are deposited upon the support and subjected to a magnetic field to produce a bead of the particles that rotates as the support moves toward a print position. A number of the particles detach from the bead and remain on the support as mutually spaced aggregates of irregular height. An electrical field of short duration, established in the print position between the particles and a shaped print electrode, charges the particles and attracts them to an intervening recipient sheet.

15 Claims, 12 Drawing Figures

FIG. 1
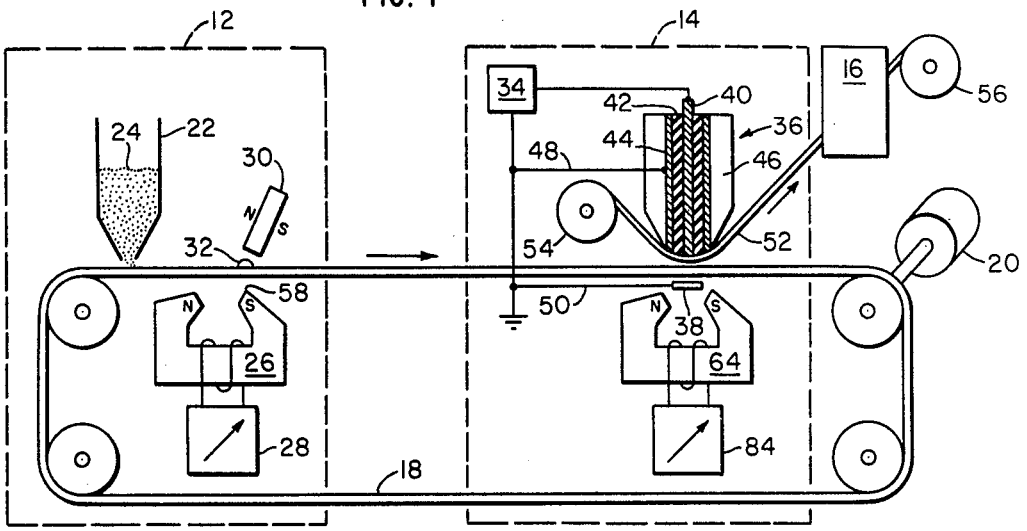
FIG. 1A
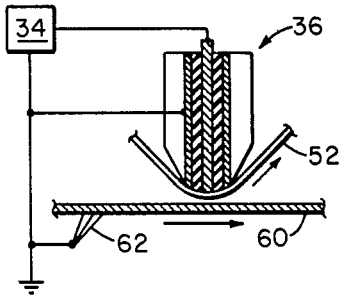
FIG. 2
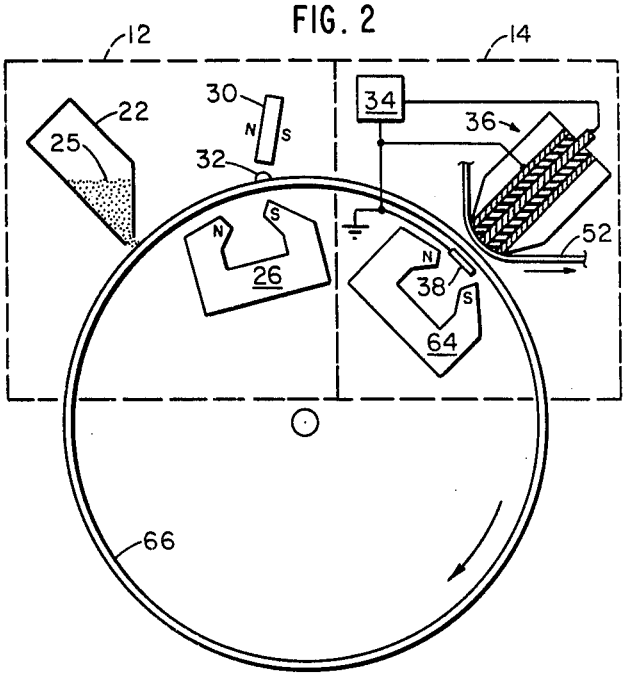
FIG. 2A
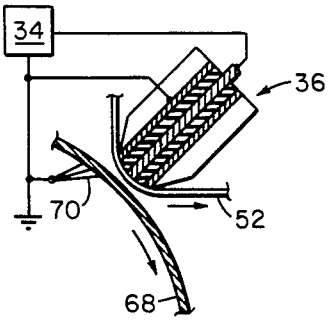
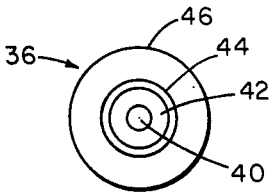
FIG. 3

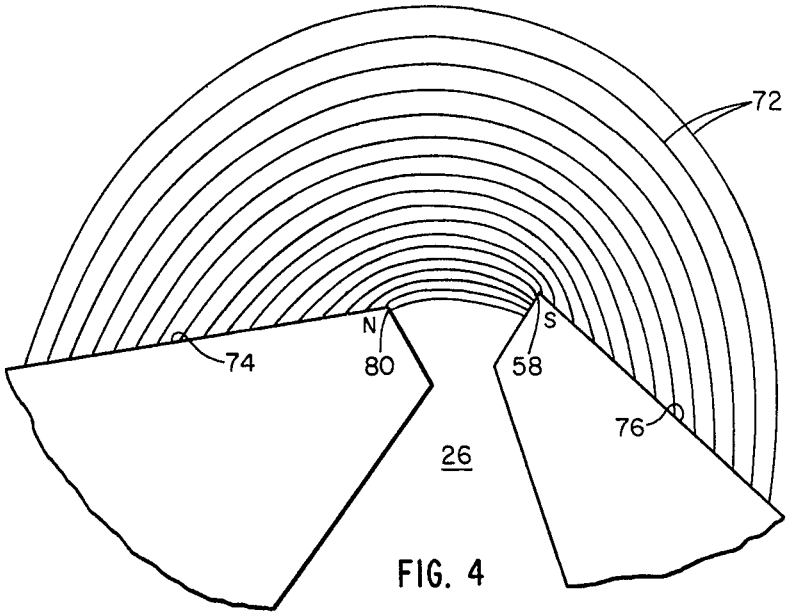
FIG. 4
FIG. 5
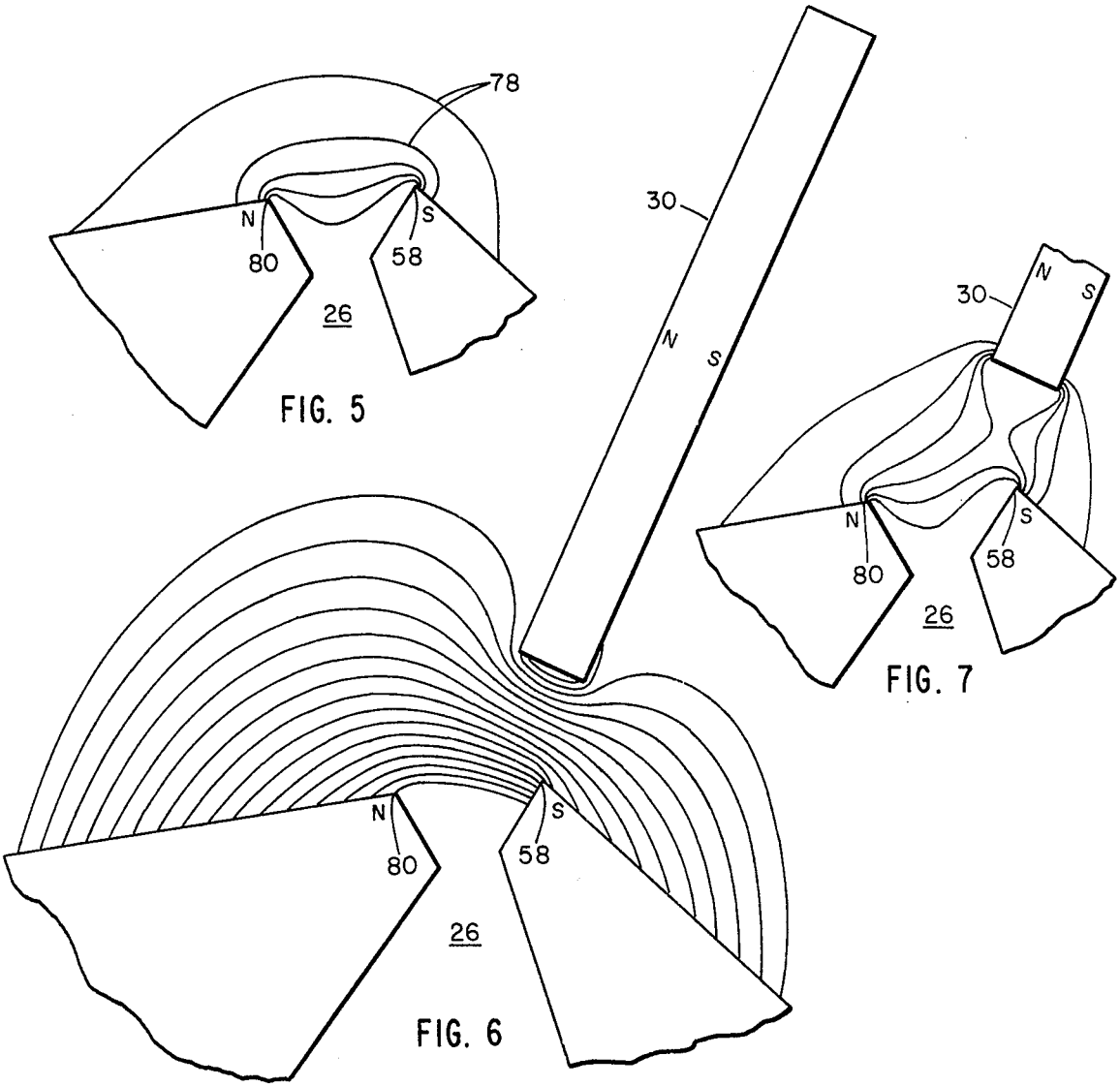
FIG. 7
FIG. 6

MAGNETIC INKING APPARATUS FOR PULSED ELECTRICAL PRINTING

RELATED APPLICATIONS

This application has been assigned to the same assignee as copending applications Ser. No. 710,282 entitled "Inks for Pulsed Electrical Printing and Methods of Producing Same," Ser. No. 710,281 entitled "Non-Impact Printer With Magnetic Ink Reorientation," and Ser. No. 710,283 entitled "Structural Donor Sheet for High-Resolution Non-Impact Printer, all filed on even date herewith," and Ser. No. 710,892 entitled "Pulsed Electrical Printer With Dielectrically Isolated Electrode," filed Aug. 2, 1976, and incorporates the disclosure thereby by reference as hereinafter specifically noted.

BRIEF SUMMARY OF THE INVENTION

This invention relates generally to apparatus for pulsed electrical printing, as contrasted to mechanical impact and electrostatic printers. Mechanical printers deliver ink to a recipient sheet by mechanical movement from a supply or donor sheet or strip. Electrostatic printers generally employ multi-step procedures involving sequential selective charging of surfaces and transfer of toner particles by electrostatic attraction. The present invention relates more directly to printers of the general type described in the U.S. patent to Robert W. Haeberle, et al U.S. Pat. No. 3,550,153 dated Dec. 22, 1970. The printing proces of said patent consists generally in providing an electrically conductive ink, a receiving or recipient paper or sheet, and a means for producing an electric field of a predetermined shape to be printed, in pulses between the ink and paper. In a typical application this field may be in the order of 1000 volts across a gap of between 5 and 10 mils, this gap being measured from the ink through the thickness of the receiving sheet to the pulsed field shaping electrode. The ink or pigment is in mobile, particulate form. During the brief presence of the electric field, the ink particles are first charged by conduction of current from other particles closer to supporting sheet, detached by the electric field, and then caused to transfer to the receiving paper by the force induced solely by the electric field. As described in said patent, the particles of conductive ink are initially deposited upon a surface of an ink support described as a donor sheet. In general, the amplitude and duration of the electric pulses must be so related as to cause an efficient transfer of sufficient ink for the required printing density, without causing an electrical breakdownor discharge beteen the electrodes.

As described in said patent, the surface of the donor sheet closest to the recipient sheet includes electrically conductive particles of a printing material disposed in a high resistance medium. The pulsed electrical field is applied to charge the printing particles selectively. The charged particles are subsequently transferred to the adjacent surface of the recipient sheet under the influence of the applied field. This is an efficient charging technique, whereby a charge is imparted to the printing particles in a very brief space of time. Because these conductive printing particles are dispersed in a high resistance medium, the electric field lines of the applied field become concentrated upon the conductive particles; thus these field lines tend to avoid the high resistance medium separating the conductive particles. The concentration of the field lines is a consequence of the concentration of induced charge upon these particles, and in addition it represents a focusing of lines of force upon the charged particles. The force on a particle depends on the electric field strength at the particle and the charge on the particle, being proportional to the product of the charge and the field strength. Both factors are increased when charge accumulates on a conductive particle, since the gathering of charge is accompanied by an increase in the density of field lines, which means an increase in the field strength, measured in lines per unit area.

In printers of the type described in said patent, having a non-homogeneous distribution of conductive particles in a poorly conducting medium, particularly a depth distribution which leaves groups of particles in mounds or towers, a printing pulse will charge preferentially those particles in preferred locations, such as the summits of mounds or towers, and these particles will be subjected to strong forces tending to detach them from their neighbors and transfer them from the donor sheet to the recipient sheet. In the practice of the printing technique described in said patent, the high resistance medium need not be a solid material, and in some cases it can be air. That is, if the donor sheet is properly constructed and inked, in such a way that the conductive pigmented particles are arranged in mounds and towers, the air surrounding and separating these mounds and towers can play the role of the poorly conducting medium in which the conductive particles are dispersed.

An object of the present invention is to provide improved methods and apparatus for inking a donor sheet. Another object is to provide means permitting the donor sheet to be reinked during operation of a printing apparatus.

A further object is to provide inking and reinking means adapted for distribution of the ink particles upon the donor sheet in a manner that facilitates the transfer of these particles to the recipient sheet in the presence of the printing pulses. Associated with this object are further objects related to the quality of the printing on the recipient sheet according to well-established criteria such as print density, edge definition, fill and resolution.

A donor sheet for non-impact printing, in which the poorly conducting medium is a solid dielectric composite material, is described in U.S. Pat. No. 3,833,409 to John Peshin, dated Sept. 3, 1974. The donor sheet is described as having a high lateral resistivity to aid in confining the printing to the immediate vicinity of the printing electrode face.

A further improvement upon the printing apparatus of said U.S. Pat. No. 3,550,153 is described in U.S. Pat. No. 3,898,674 to Paul L. Koch dated Aug. 5, 1975. This patent describes a shield electrode that confines the printing field distribution more narrowly than would be possible with an unshielded printing electrode. It has been found that with the printing field distribution thus confined, satisfactory high resolution printing is obtained with a conductive base or support for the pigment particles, provided that the structure of the base or support and the arrangement of the pigment particles thereon are such as to produce a partial isolation of the conductive pigment particles into mounds and towers that are separated by a poorly conducting medium, such as air or a suitable solid material.

With the above-mentioned objects in view, the present invention comprises a magnetic inking station at which the ink particles are distributed in towers and mounds over the surface of a microcavernous base layer to form a structured donor sheet. In accordance with this invention, the conductive printing particles contain magnetizable material such as iron oxide. In some cases the base layer itself contains magnetizable material. In any case, the base layer surface microcavernous, thereby providing a frictional force that operates in conjunction with magnetic forces to produce a reservoir or bead of print particles on the surface of the base layer, this bead rotating while the base layer passes beneath it. A sufficient number of printing particles peels from this rotating bead to coat the base layer, which then passes to the printing station. The coating on the base layer is in the form of irregular mounds and towers, whereby the field lines produced at the printing station are focused thereon. It is the combined action of the base layer with its microcavernous surface structure, and the magnetic field distribution with its characteristic tendency to cause magnetizable particles to line up in strings aligned with the magnetic field lines, that results in the desired arrangement of the printing particles in mounds and towers.

In those cases where the base layer or support itself contains magnetizable material, the mounds and towers cling more firmly to the base layer than when the base layer is non-magnetic, thus providing an advantage in high-speed printers by tending to prevent the printing particles from being thrown off of the base layer as it moves rapidly from the inking station to the printing station.

Thus the features of this invention include the provision of a magnetic inking station that distributes the conductive printing particles over the surface of the base layer or support in mounds and towers suitable for use in the printing station of a high-speed non-impact printing system. Further, the inking station is operable to retain the conductive printing particles in a compact bead while they are being distributed over the base layer, thus preventing them from being dispersed into the air as contaminates.

A further feature is that the arrangement of magnets in the magnetic inking station is designed to provide a magnetic potential well, which will hold and retain the main bulk of the magnetizable conductive printing particles within a geometrically limited region. This region is a longitudinally extended region, oriented laterally of the direction of travel of the base layer, within which the compact bead of printing particles will rotate when subjected to the combined action of the magnetic field and the frictional force provided by the movement of the base layer with its microcavernous upper surface.

The rotating bead of magnetizable conductive printing particles has the effect of metering the particles on to the base layer. However, the outer surface of the metered layer of print particles is not smooth and even, as might result from the use of a docotor blade for example, but is irregular, containing many mounds and towers on which the lines of the applied electric field can concentrate, thus producing effective amplification of the incident electric field pulses by as much as two orders of magnitude or more. In particular, the arrangement of the deposited particles in mounds and towers leads to the concentration of electric field lines on the selected particles to be printed at the printing station, and to their electrical charging during the printing pulse, followed by their detachment and transportation across the air gap separating the donor sheet and the recipient sheet.

According to this invention, the magnetic inking station spreads out the printing particles on the base or support in a layer that is even on a scale of the order of 200 times a particle diameter, but nonhomogeneous on a scale of the order of 20 times a particle diameter, with an appearance of mounds and towers that is strongly nonhomogenous on the latter scale.

BRIEF DESCRIPTION OF THE DRAWINGS

FIG. 1 is a partially schematic drawing of a pulsed electrical printer employing the invention, with a donor sheet in the form of an endless belt of high electrical resistance material.

FIG. 1A is a fragmentary drawing illustrating a variant of FIG. 1 employing an endless metallic belt.

FIG. 2 is a partially schematic drawing of a pulsed electrical printer embodying the invention, with a donor sheet in the form of a thin-walled rotating drum of high electrical resistance material.

FIG. 2A is a fragmentary view showing a variant of the embodiment of FIG. 2 employing a metallic rotating drum.

FIG. 3 is an end view of one form of print electrode used in each of the several illustrated embodiments.

FIG. 4 is a partial view of the reinking station showing the magnetic field lines generated by the lower magnet.

FIG. 5 is a view similar to FIG. 4 with contours showing the distribution of lines representing the square of the magnitude of the magnetic field strength.

FIG. 6 is a view similar to FIG. 4 showing the magnetic field lines generated by the combination of the lower magnet and the overhead magnet.

FIG. 7 is a view corresponding to FIG. 6, but showing the contours of lines representing the square of the magnitude of the magnetic field strength.

DETAILED DESCRIPTION

Figure 8:
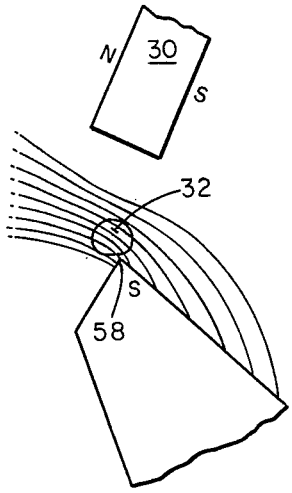
FIG. 8 is an enlarged detail view showing a cross section of the rotating bead of the magnetizable conductive printing particles together with some of the magnetic lines of force.

FIG. 1 illustrates diagrammatically a pulsed electrical printer embodying the invention. The printer comprises a reinking station 12, a printing station 14, a fusing station 16, and other associated components as hereinafter described. An endless belt 18 of high electrical resistance material, having a roughened or microcavernous outer surface, is driven continuously by a drive motor 20. This belt and the other forms of ink support described herein are preferably constructed as described in said application Ser. No. 710,283 entitled "Structured Donor Sheet for High-Resolution Non-Impact Printer," the description of which is incorporated herein by reference. Also, other methods may be used in particular applications. In particular, base sheets having high lateral resistivity, for example as described in said U.S. Pat. No. 3,833,409, and sheets of other forms having high resistance or insulating base structure as described in said U.S. Pat. No. 3,550,153, may be used. In any case, the surface of the ink support should have a roughened or microcavernous surface as hereinafter further described. A hopper 22 deposits particulate printing particles 24 upon the surface of the belt, which then travel past a lower magnet 26, which may be a permanent magnet or an electromagnet energized by a variable source 28. Although a hopper has been shown in the drawing for illustration, any other suitable means for depositing the particles on the belt may be used. In certain embodiments, an overhead magnet 30 may also be employed. The printing particles contain magnetizable material and are preferably produced by the method described in said copending application Ser. No. 710,282 entitled "Inks for Pulsed Electrical Printing and Methods of Producing Same," the description of which is incorporated herein by reference. In the presence of the magnetic field, the printing particles deposited on the belt 18 form a rotating bead 32 from which a portion of the particles are peeled off and travel toward the printing station.

In the printing station, a source 34 of brief electrical pulses applies such pulses selectively between one or more print electrodes 36 and a base electrode 38. For simplicity, only a single print electrode 36 has been illustrated, whereas a practical printer is provided with a plurality of electrodes and means for selectively energizing them, as described in said U.S. Pat. No. 3,898,674 and in U.S. Pat. No. 3,733,613 to Paul L. Koch, et al dated May 15, 1973. Also, it will be understood that although the illustrated print electrode is shaped for printing a round dot as used in facsimile and dot matrix alphanumeric printers, other shapes of electrodes may be employed. As shown in FIGS. 1 and 3 and in accordance with the teachings of said U.S. Pat. No. 3,898,674, the electrode 36 comprises a metallic field shaping electrode 40, an electrically insulating material 42, a metallic shield electrode 44 and a supporting body 46. By connections 48 and 50, the shield electrode and the base electrode are held at the same electrical potential.

By the action of brief electrical printing pulses between the field shaping electrode 40 and the base electrode 38, printing particles are transferred from the belt 18 to a web or sheet of ordinary untreated paper 52 passing from a supply roll 54 to a take-up roll 56. After the deposit of printing particles on the recipient paper 52, the latter passes through a fusing station 16 which provides sufficient heat to fuse the particles, thereby spreading them out and causing them to be more firmly attached to the paper. Details of the fusing step are given in said application Ser. No. 780,282 entitled "Inks for Pulsed Electrical Printing and Methods of Producing Same," and are incorporated herein by reference.

The rotating bead 32 is a loose aggregation of magnetizable conductive printing particles, these particles being preferably produced by the methods described in said last-mentioned application. A portion of the contour of the bead is roughly cylindrical in shape, and in cross section it approximates a circle that is flattened on the side adjacent to the moving belt 18. The friction of the moving belt propels the lower surface of the bead toward the printing station 14, but the magnetic field distribution within the reinking station 12 is such as to oppose the forward motion of the magnetizable grains or particles in the bead, once these grains have moved a short distance past a corner 58 of the magnet 26 and have reached a region of weakened magnetic field. In some embodiments, this invention may be practiced using the lower magnet 26 alone, and in other embodiments the field may be produced by the magnet 26 in combination with the overhead magnet 30 as described below. Instead of moving forward out of the strong field region, most of the grains in the lower part of the bead 32 will move upwardly away from the belt surface and participate in the rotational motion of the bulk of the grains in the bead.

However, at the point where most of these grains turn and move upwardly, away from the surface of the belt, the orientation of the magnetic lines of force is such that the magnetizable grains will be aligned in small chains or threads running between the belt surface and the surface of the bead that is separating itself from the belt. Some of these chains or threads will elongate during the separation process, and will then break in two, leaving a portion of each broken chain on the surface of the belt, oriented upwardly from the belt surface.

The grains thus left on the belt surface are in many cases arranged in mounds and towers, such arrangement being advantageous for efficient operation of the printing station 14.

FIG. 1A illustrates a variant of the embodiment of FIG. 1, in which the belt 18 is replaced by an endless belt 60 made of metal or other conductive material having a roughened or microcavernous surface. In this case a brush 62 or other equivalent means is connected with the source 34, whereby the belt 60 itself functions as a base electrode, thereby replacing the function of the electrode 38 in FIG. 1.

In the embodiments of FIG. 1 and 1A, the printing station 14 is preferably provided with a magnet 64 that is operable to reorient some of the mounds and towers of printing particles in a manner more specifically described in said application Ser. No. 710,281 entitled "Non-Impact Printer With Magnetic Ink Reorientation," the description of which is incorporated herein by reference.

In the embodiment of FIG. 2, many of the elements are the same as those illustrated in FIG. 1. However, a thin walled rotating drum 66 of high electrical resistance material serves as the donor sheet or support for the printing ink particles, replacing the moving belt 18. The outer surface of the drum 66 is microcavernous, providing sufficient frictional force to maintain the rotational movement within the bead 32. The inking station 12 contains, as in FIG. 1, the lower magnet 26 and the overhead magnet 30, establishing a magnetic potential well that restricts the forward motion of the bead 32. The inking station 12 also contains the hopper 22 with its reservoir of ink or pigment particles 25, by which the supply of particles in the bead 32 is replenished.

The embodiment of FIG. 2A is similar to the embodiment of FIG. 2, except that the drum 66 is replaced by a drum 68 of metal or other electrically conductive material, and a brush 70 is connected to the source 34, whereby the drum 68 replaces the function of the base electrode 38.

In the embodiments of FIGS. 2 and 2A, the rotating bead 32 acts to meter and distribute the magnetizable conducting printing particles over the outer surface of the rotating drum 66 or 68. The drum carries its inked surface around the printing station 14. The printing station contains the print head or electrode 36. The receiving web or recipient sheet 52 passes between the print head and the ink surface of the rotating drum. Means similar to elements of FIG. 1 move the receiving web 52 from a supply roll to a take-up roll through a fusing station.

Referring to FIG. 4, an enlarged simplified view of the poles of the lower magnet 26 is shown. In this figure it is assumed that the overhead magnet 30 is not employed in the reinking station 12. As shown in this drawing, a magnetic field represented by field lines 72 of relatively simple configuration is obtained. An upper left surface 74 of one pole as viewed in the drawing may be considered as a number of distributed north magnetic poles, while an upper right surface 76 may be considered as a balancing distribution of south magnetic poles.

FIG. 5 again shows the lower magnet 26, as in the case of FIG. 4, but illustrates the magnetic field distribution in a different manner. Whereas FIG. 4 shows the actual lines of magnetic force, FIG. 5 shows lines 78 contoured to represent the square of the magnitude of the magnetic field strength. The contours of the lines 78 indicate that the strongest field intensity is found in the vicinity of the upper corner 58 and an upper corner 80. In FIG. 4 it can be seen that the magnetic field lines are closest together in the same two regions adjacent to the two corners 58 and 80.

FIGS. 6 and 7 illustrate the effect of adding the overhead magnet 30 according to certain embodiments of this invention. As viewed in the drawing, this overhead magnet is oriented so that the polarity of the left side thereof matches the polarity of the left side of the lower magnet 26, and the opposite polarities of the magnets are correspodingly matched, as shown by the symbols "N" and "S." Comparison of FIG. 6 with FIG. 4 shows that the overhead magnet has the effect of pressing together the magnetic lines of force, producing a localized region of strong magnetic field. Comparison of the contours shown in FIG. 7 with those shown in FIG. 5 provides additional information as to the nature of the field compression contributed by the overhead magnet. In particular, the shape of the contours near the upper right corner 58 of the lower magnet 26, where the rotating bead 32 is ordinarily positioned, matches to some extent the shape of the bead itself, as will be seen more clearly by reference to FIG. 9 discussed below.

FIG. 8 illustrates the approximate cross section of the bead 32 with some of the magnetic field lines corresponding to FIG. 6 superimposed thereon. It will be noted that several magnetic field lines cross the right-hand boundary of the bead at approximately the same angles with the curved boundary of the bead. In this region of the field at this boundary coacts with the frictional force, resulting in a rotational motion of the bead, with bulk movement of the bead material upwardly around this right-hand curved boundary. The grains on the outside of the bead will move and turn in such a way that the direction of the magnetic field, as experienced by these grains, is substantially constant over a considerable part of the upward motion.

Figure 9:
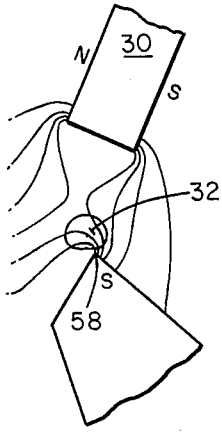
FIG. 9 shows the same cross section as FIG. 8, together with some of the contours showing the distribution of the square of the magnitude of the magnetic field strength.

FIG. 9 is a view similar to FIG. 8, except that it shows the contours of lines representing the square of the magnitude of the magnetic field strength, superimposed upon the cross section of the rotating bead 32. This figure shows that the right-hand side of the bead lies along a locus that fits readily within the family of curves represented by these contour lines. Accordingly, a grain that moves upwardly along the outside of the bead, following the right-hand boundary of the bead, will be moving in such a way that the magnitude of the magnetic field experienced by this grain will be substantially constant during a considerable part of this upward motion.

Thus FIGS. 8 and 9 show that the curved upward motion of a magnetizable conductive printing particle, on the right-hand side of the rotating bead, includes a substantial path over which this particle will be subject to a magnetic field that is constant in magnitude, and also constant in direction relative to a coordinate system that moves and turns with the particle in its motion on the outside of the bead.

From FIG. 9, it can be seen that the upward motion of the particle on the outer right-hand side of the bead will be followed by a curving motion toward the left, as the particle moves with the surface of the rotating bead. This leftward motion is into a stronger magnetic field. As the particle on the outer surface of the bead continues its motion around the bead periphery, it will remain in a strong magnetic field, the latter being stronger than the field on the right-hand side of the bead, while the particle moves downwardly on the left side of the bead, and then moves to the right side along the bottom of the bead where the particle will rest on the moving belt or drum surface. While the particle is moving toward the right-hand side of the boundary of the rotating bead in this manner, it is moving toward a region of weaker magnetic field strength.

Thus the particles that remain within the rotating bead are in the weakest magnetic field that will encounter while they are moving upwardly on or near the right-hand side of the bead. During their upward motion at or near this side the magnetic field experienced by these grains is not changing substantially either in magnitude or in direction as referenced to a coordinate system that moves and turns with the particular magnetizable grain.

Figure 10:
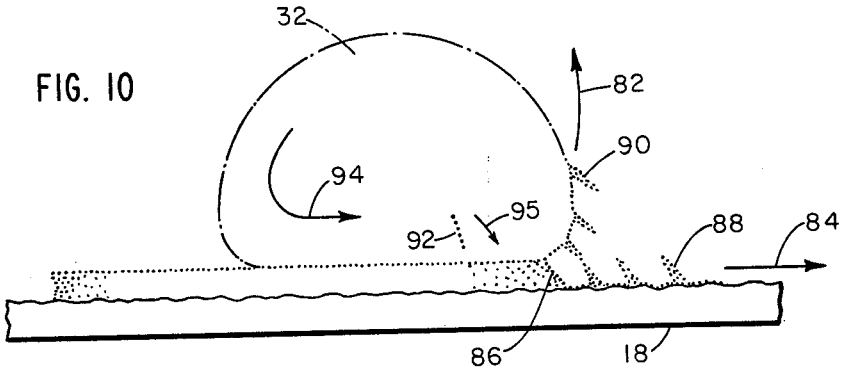
FIG. 10 is a diagram representing the rotating bead, for illustration of the manner in which particles are peeled off therefrom while the remainder continue to remain in the bead for one or more additional circuits around its periphery.

It has been found that the bead 32 rotates easily when the magnetic field strength at the right-hand side of the bead boundary as viewed in FIGS. 8 to 10, is approximately equal to, or somewhat less than, the magnetic field at which the magnetizable material within the grains saturates. It is well known that when a magnetizable material is subjected to a magnetic field above its saturation level, the material presents little or no resistance to the rotation of the magnetization within the material. On the other hand, when the magnetic field strength is below the saturation field level, the property of rotational hysteresis becomes of appreciable importance. This property manifests itself as a resistance to the rotation of the direction of the magnetization within the magnetizable material. Thus, when the applied magnetic field is below the strength needed to saturate the magnetizable material, a change in the direction of the applied field will cause the induced magnetization in this material to lag behind the applied magnetic field, so that the magnetization vector points in a somewhat different direction from that of the field vector.

The magnetizable material in the bead particles will participate in the mechanical motion associated with the bulk rotation of the bead as described above. At the same time, the magnetizable material will be subject to magnetic forces by the applied magnetic field upon the magnetization within the material. This magnetization, in turn, follows the changing magnetic field that the material experiences with a lagging relationship thereto introduced by the hysteresis properties of the material, as noted above.

This lag is not significant as long as the material remains within the region where the applied magnetic field exceeds the saturation magnetic field for the magnetizable material. Most of the rotating bead lies within this strong field region. However, as the material in the bottom of the bead moves to the right and approaches the right hand boundary of the bead, it moves into a weaker magnetic field, where the hystersis lag becomes more important. Here the magnetization of the material acquires a certain amount of momentum or "set."

As the magnetized grains or particles of ink material move in the direction of belt motion in the lower part of the bead, they encounter forces whose vectors, represented by arrows 82 and 84 in FIG. 10, are bifurcated. The lowermost portion of the material is pulled outwardly with the belt by the force 84 into a region where the magnitude of the magnetic field is reduced, but the direction of the magnetic field changes only very slowly. At the same time, the material just above this lowest portion is pulled upwardly by the force 82 to follow the contour of constant magnitude-squared of the magnetic field, along with the direction of the magnetic field also remains constant, relative to a coordinate frame that moves and turns with the motion of the magnetizable material. The portion that moves upwardly then continues around the periphery of the bead 32 until it reaches once again the bifurcation point.

Because the cross section of the bead is not a simple circle but a circle flattened on its bottom, the movement of the material in the bead will not be a simple rotation, but will include some turbulent mixing. Furthermore, the replenishment of magnetizable material from the hopper 24, or other convenient means of replenishment, will cause modification of the detailed structure of the rotating bead. However, the replenishment ink particles are added to the bead at a strong field location where there is no significant hysteresis lag. Thus the operation of the bifurcated forces as described above will not be changed materially by the replenishment mechanism.

FIG. 10 shows the bifurcation process somewhat diagrammatically for purposes of explanation, and at substantial magnification. The movement of the magnetizable material from the strong field at the left periphery of the bead 32 to the weaker field region at the right hand periphery is a movement from a region in which the magnetization follows the imposed magnetic field precisely to a region in which the field is weaker and the magnetization is lagging behind the imposed magnetic field as the result of hysteresis. In the weaker field region, the material is pulled in two directions at the same time. A portion of the magnetizable material is pulled downwardly and forwardly, while the remainder of the material is pulled upwardly around the right-hand boundary of the rotating bead.

It will be noted from FIG. 8 that the bifurcation process takes place in a region in which the magnetic field lines are directed steeply down toward the right. As the loosely clumped grains in the bead are pulled apart, they will tend to line up in chains 86 (FIG. 10) parallel to the magnetic field lines, and these chains or threads will stretch until they finally break in two. When a thick chain 86 of magnetizable particles stretches, it will become thinner, approaching a single row of individual particles, though it is most likely to break apart before it actually reaches this degree of thinness. However, during the stretching and thinning process, space will open up between adjacent chains, as represented in FIG. 10. Accordingly, when the chains finally break, the magnetizable particles that cling to the surface of the belt 18 (or drum 66) will stand in small mounds and towers 88.

The clinging of the lower chain segments 88 to the base layer is a consequence, in part, of the adhesion between the lowest grains and the microcavernous surface of the base layer or belt. Magnetic material such as nickel or a nickel alloy may be incorporated into this base layer to increase the amount of magnetizable ink material that remains coated in mounds and towers on the surface of the base layer after the base layer has pulled away from the main bulk of the rotating bead 32 and moves toward the printing station 14. For example, the magnetic material may be present as discrete spaced particles in the base layer as described in said application Ser. No. 710,283 entitled "Structured Donor Sheet for High-Resolution Non-Impact Printer."

In FIG. 10, therefore, certain chain segments 90 are broken away from the segments 88 and follown an additional circuit around the rotating bead. FIG. 10 also shows a chain 92 within the bulk of the bead 32. The chain 92 is moving bodily to the right along with the bulk motion of the bead and material as indicated by an arrow 94. As it moves from the strongest field region into somewhat weaker fields, below the saturation field strength as noted above, the rotational hysteresis discussed above will tend to cause the chain 92 to retain its earlier magnetization, rather than to immediately change its magnetization to follow the changing field strength and field direction to which it is subjected.

Viewing these phenomena of bead rotation in a somewhat different way, it is evident from an examination of the field lines in FIG. 8 that the movement to the right by the ink particles will bring the magnetized chain 92 into a region where the magnetic field is not quite as steep as it was, and has the somewhat less steep orientation indicated, for example, by the vector 95 in FIG. 10. There will then be a torque in the counterclockwise direction exerted by the magnetic vector 95 upon the magnetized chain 92. A similar torque will also be exerted upon other chains of magnetized particles within the bulk of the bead 32, as these chains move to the right and emerge from the strongest field region into the region where the field is weaker than the saturation field. It is this torque, acting on the main bulk of the particles in the lower right-hand corner of the bead, that is believed to be responsible at least in part for the turning upwardly of this part of the bead, which initiates the rotational motion of the whole bead, and which makes the main bulk of the bead pull away from the base layer 18 as illustrated in FIG. 10.

By itself, however, this torque can only initiate the turning motion of the material in the bead. Only a small angular change can be directly attributed to the torque acting alone. There is a much stronger force acting together with this torque to change the rightward motion of the material in the lower part of the bead into upward motion along the right-hand side of the bead. This stronger force is the gradient of the magnitude-squared of the magnetic field strength, acting on the magnetization induced in the material of the bead. This force resists the rightward motion of bead material, such as the segment 90 in FIG. 10, and deflects the rightward motion into an upward motion, reinforcing the rotational movement that was initiated by the torque discussed above.

There is thus a combined action of the torque and the gradient, in influencing the separation process depicted in FIG. 10. This action can be changed through changes in the parameters controlling the detailed magnetic field configuration. It is found, in particular, that a small upward retraction of the overhead magnet 30 alters the magnetic field in such a way that the amount of magnetizable material coated on the base layer or belt 18 is significantly increased, though at the cost of a somewhat reduced stability of the bead structure at high travel speeds of the belt or drum.

From the foregoing description, it will be noted that the lower magnet 26 and overhead magnet 30 coact to produce a shaped magnetic field having certain desirable characteristics. This field contains an inner strong-field region, roughly cylindrical in shape. Within this inner volume the magnetic field strength is equal to or stronger than the field strength at which the magnetizable particles of ink will become at least 90 percent saturated when placed within this inner volume. On the exit side of this inner volume, the magnetic field becomes rapidly weaker, with the magnetic lines of force spreading apart as shown in FIG. 8 along the right-hand portion of the bead boundary. At the corner where the exit side of the inner volume intersects the path of the microcavernous surface of the base layer, the magnetic lines of force are oriented steeply with the angle between a line of force and the normal to the base layer lying in the range from 5° to 40°. The exit side of the inner strong-field volume is a convex curved cylindrical surface that is crossed by magnetic lines of force. Over a substantial part of this exit side, the lines of force cut the surface at angles (relative to the surface normal) that are all approximately equal to one another. This exit side of the inner strong-field volume then forms the side, approximately, of a rotating bead of magnetizable conductive printing particles, that is confined to a region within the inner strong-field volume, except along the exit side where some of the particles are moving through a region in which the magnetic field is significantly weaker than the saturation field for the magnetizable material. In this weaker-field region, however, the turning motion of the rotating bead ensures that the particles move with their magnetization substantially unchanging.

The bead turns freely in the shaped magnetic field. The part of the bead that is in the strong-field region turns freely because the magnetically saturated material in the bead is not significantly impeded by rotational hysteresis. The part of the bead that is in the region of weaker field, along the exit side of the bead, turns freely because the material moves with its magnetization substantially unaltered by the motion. The frictional force provided by the motion of the surface of the belt or drum against the underside of the bead is sufficient to produce the rotation of the bead, against any residual resistance attributable to incomplete saturation in the main body of the bead, or to locations along the exit side of the bead where the magnetization does not remain precisely constant during the movement of the bead material through the weaker field region.

The energy delivered to the rotating bead by the frictional force from the moving base layer (belt or drum) is also sufficient to provide the energy needed for the process by which a layer of magnetizable material is peeled off the periphery of the bead as the coating of the base layer, to be carried on the base layer from the inking station 12 to the printing station 14.

Because of the orientation of the magnetic lines of force at the corner where this peeling action takes place, the magnetizable material is separated into stretched chains of particles, which break to leave segments on the surface of the base layer. These segments form mounds and towers that serve to make the coated base layer satisfy the requirements of the donor sheet.

In the practice of this invention, the magnitude of the magnetic field strength within the shaped magnetic field is determined according to the particular application. This magnitude is dependent on the hysteresis curve for the specific magnetizable material within the ink particles. In a typical case in which the materal is produced as described in Formula 2 of said application entitled "Inks for Pulsed Electrical Printing and Methods of Producing Same," this material becomes 90 percent saturated at approximately 2000 oersteds. Thus in this application the inner strong-field volume will have a magnetic field strength that is approximately 2000 oersteds or greater, and the weaker field along the exit side of the bead will be somewhat less than 2000 oersteds.

A second variable factor is the geometrical size of the strong-field region. In practice, this is related to the geometrical size of the rotating bead 32 itself. When the last-mentioned ink is used and the diameter of the bead is approximately 0.3 cm., it is found that with a particular magnetic field configuration, the forward speed of the base layer is limited to a maximum that is between about 50 and 75 cm. per second. A further increase in the size and strength of the magnets or in the content of magnetizable material, or both, permits a further increase in the diameter of the rotating bead, and also a further increase in the forward speed of the base layer as it moves from the inking station to the printing station, for example up to 125 cm. per second.

In those embodiments employing an endless belt as the base layer, the belt may be very thin and the magnet geometry can be on a small scale, both with respect to geometrical size and with respect to magnetic field strength. In embodiments employing a rigid drum as the ink support, the drum having relatively greater thickness than a belt, the magnet geometry is required to be relatively larger. In the latter case, the dimensional size of the lower magnet 26 and the overhead magnet 30 will be relatively larger and the magnetic pole strengths will also be greater, in order that the strong-field region shall extend well above the thickness of the drum and give adequate volume above the base layer for a rotating bead of magnetizable material having sufficient diameter to permit high-speed rotation without instability.

As noted above, in certain embodiments is is desirable to include magnetic material such as nickel in the base layer on the surface of the belt or drum. The magnetic material in the base layer not only increases the adhesion of the magnetizable grains in the bead to the surface of the base layer, but also increases the thickness of the coating deposited on the base layer in the magnetic inking station. This coating is also held more firmly to the base layer during its movement toward the printing station.

It will be understood that although a particular polarity of the magnets has been described, the symbols "N" and "S" may be interchanged in the drawing.

In embodiments of the invention employing either a belt or a drum as the ink support, the poles of the magnet 26 have sharp ridges at the corners 58 and 80. The distance between these corners may be in the range between 1.25 and 5 cm., for exmple. The ridge at the corner 58, which may be termed the exit side, will be somewhat higher than the ridge at the corner 80, which may be termed the entrance side. This results from the fact that the rotating bead 32 is located close to the ridge on the exit side, and is dependent upon the rapidly-changing, localized magnetic field. The corresponding ridge on the entrance side is located somewhat below the path of the base layer to reduce the likelihood that an undesired bead might form over this ridge on the entrance side of the strong-field region.

The north polarity pole piece on the entrance side, and the south polarity pole piece of the exit side can be pole pieces associated with a single magnet, as illustrated. Alternatively, they can be polarized sides of two separate magnets, appropriately positioned.

In both the belt and drum embodiments, the overhead magnet 30 parallels the lower magnet structure 26, in that the north polarity pole is on the entrance side and the south polarity pole is on the exit side. These poles may comprise the two opposite faces of a single magnetized plate. The overhead magnet structure is positioned roughly opposite to the ridge at the corner 58 of the exit-side pole piece of the lower magnet, but tilted forward and displaced forward, toward the direction in which the base layer is moving. The overhead magnet structure is also retracted from the lower magnet structure to leave space for the shaped magnetic field that is to contain the rotating bed 32.

The distance between the corner 58 and the nearest part of the overhead magnet structure may be in the range between 0.75 and 3.8 cm., for example. The separation between north and south pole surfaces of the overhead magnet structure in such case may be in the range from 0.5 to 2.5 cm.

We claim:

1. Apparatus for coating an elongate sheet with ink comprising, in combination, means for moving the sheet in a longitudinal direction, means for depositing a quantity of ink particles loosely upon a surface of the sheet, the particles comprising a magnetizable material, and means for establishing a stationary magnetic field having components extending from said surface through the deposited particles, said field being oriented and of sufficient magnitude to act in conjunction with the friction of the moving sheet to produce a bead of said particles at said surface rotating about an axis passing substantially through the bead and extending laterally of said direction, whereby a number of the particles in the bead are separated therefrom by said sheet and remain coated thereupon in the form of spaced aggregates of irregular height.

2. Apparatus according to claim 1, in which the means for establishing a magnetic field are located on the side of the sheet opposite to said surface.

3. Apparatus according to claim 1, in which the means for establishing a magnetic field have poles located on both sides of the sheet.

4. Apparatus according to claim 1, in which the means for establishing a magnetic field include a horseshoe magnet located on the side of the sheet opposite to said surface.

5. Apparatus according to claim 4, in which the means for establishing a magnetic field include a second magnet on the side of the sheet opposite to the horseshoe-shaped magnet.

6. Apparatus according to claim 1, in which the lines of force of the magnetic field have substantial components in said longitudinal direction.

7. Apparatus for supplying ink to a printing station comprising, in combination, an elongate sheet having an ink-receiving surface means for moving the sheet in a longitudinal direction between an inking station and a printing station, means for depositing a quantity of ink particles loosely uoon said surface, the particles comprising a magnetizable material, and means for establishing a stationary magnetic field having components extending from said surface theough the deposited particles, said field being oriented and of sufficient magnitude to act in conjunction with the friction of the moving sheet to produce a bead of said particles at said surface rotating about an axis passing substantially through the bead and extending laterally of said direction, whereby a number of the particles in the bead are separated therefrom by said sheet and remain coated thereupon in the form of spaced aggregates of irregular height.

8. Apparatus according to claim 7, in which said surface of the sheet is continuous.

9. Apparatus according to claim 7, in which the sheet contains a magnetizable material.

10. Apparatus according to claim 9, in which the magnetizable material is distributed in the form of discrete particles.

11. Apparatus according to claim 10, in which the sheet comprises a base material having a coating thereon, said coating having a microcavernous surface, the particles of magnetizable material being dispersed in the coating.

12. Apparatus according to claim 7, in which the lines of force of the magnetic field have substantial components in said longitudinal direction.

13. Apparatus according to claim 7, in which said surface is microcavernous.

14. Apparatus according to claim 7, in which the strength of the magnetic field is sufficient to cause substantial saturation of a portion of the magnetizable material in the ink particles within the bead.

15. Apparatus according to claim 14, in which a portion of the bead is located within a magnetic field which is below the level that would cause substantial saturation of the magnetizable material in the ink particles.

* * * * *

UNITED STATES PATENT AND TRADEMARK OFFICE

CERTIFICATE OF CORRECTION

PATENT NO. : 4,101,909

DATED : July 18, 1978

INVENTOR(S) : Donald C. Solmon and Donald J. J. Lennon

It is certified that error appears in the above-identified patent and that said Letters Patent are hereby corrected as shown below:

Column 1, line 43, after "to" insert --a--; line 55, cancel "disposed" and substitute --dispersed--.

Colum 5, line 52, cancel "780,282" and substitute --710,282--.

Column 6, line 66, after "around" insert --to--.

Column 7, line 51, cancel "of".

Column 9, line 15, cancel "out-" and substitute --on---.

Signed and Sealed this

Sixth Day of March 1979

[SEAL]

*Attest:*

RUTH C. MASON
*Attesting Officer*

DONALD W. BANNER
*Commissioner of Patents and Trademarks*